US009115313B2

(12) United States Patent
Hippe

(10) Patent No.: US 9,115,313 B2
(45) Date of Patent: Aug. 25, 2015

(54) FLOOR CONSTRUCTION FOR HORIZONTAL COKE OVENS

(75) Inventor: Werner Hippe, Gladbeck (DE)

(73) Assignee: UHDE GMBH, Dortmund (DE)

( * ) Notice: Subject to any disclaimer, the term of this patent is extended or adjusted under 35 U.S.C. 154(b) by 979 days.

(21) Appl. No.: 12/227,999

(22) PCT Filed: May 25, 2007

(86) PCT No.: PCT/EP2007/004656

§ 371 (c)(1),
(2), (4) Date: May 13, 2009

(87) PCT Pub. No.: WO2007/140891

PCT Pub. Date: Dec. 13, 2007

(65) Prior Publication Data

US 2009/0283395 A1 Nov. 19, 2009

(30) Foreign Application Priority Data

Jun. 6, 2006 (DE) ..... 10 2006 026 521
Jun. 6, 2006 (DE) ..... 20 2006 009 985 U

(51) Int. Cl.

| | |
|---|---|
| ***C10B 5/06*** | (2006.01) |
| ***C10B 15/02*** | (2006.01) |
| ***C10B 29/02*** | (2006.01) |

(52) U.S. Cl.
CPC . *C10B 29/02* (2013.01); *C10B 5/06* (2013.01); *C10B 15/02* (2013.01)

(58) Field of Classification Search
CPC ..... C10B 5/06; C10B 15/02; C10B 29/02
USPC ..... 202/134, 138, 145, 222, 223, 267.1, 202/268, 270; 52/302.1
See application file for complete search history.

(56) References Cited

U.S. PATENT DOCUMENTS

| | | | | | |
|---|---|---|---|---|---|
| 733,872 | A | * | 7/1903 | Ramsay | 202/211 |
| 1,431,486 | A | * | 10/1922 | Posnack | 202/223 |
| 1,756,170 | A | * | 4/1930 | Blackwell | 202/223 |
| 4,287,024 | A | * | 9/1981 | Thompson | 202/134 |
| 5,228,955 | A | * | 7/1993 | Westbrook, III | 202/93 |
| 6,017,214 | A | * | 1/2000 | Sturgulewski | 432/247 |

* cited by examiner

*Primary Examiner* — Jill Warden
*Assistant Examiner* — Joye L Woodard
(74) *Attorney, Agent, or Firm* — Marshall & Melhorn, LLC

(57) ABSTRACT

The invention relates to a coke oven of a non-recovery horizontal type of construction, known as a non-recovery or heat-recovery coke oven, in which the coke oven floor is made up of at least two layers and each layer is formed of the same or different silica materials, wherein the first layer, seen from the oven space, is formed from a solid refractory material and the second layer comprises a multiplicity of openings, gaps, apertures or the like, the gas spaces of these openings, gaps, apertures or the like being in communication with the gas space of the flue gas duct running under them.

15 Claims, 3 Drawing Sheets

FLOOR CONSTRUCTION FOR HORIZONTAL COKE OVENS

BACKGROUND OF THE INVENTION

The invention relates to a coke oven of horizontal construction, a so-called non-recovery or heat-recovery coke oven, in which the coke oven floor is built up of at least two layers which are formed of the same or different refractory materials. The first layer, viewed from the oven space, is formed of a solid material, and the second layer comprises a plurality of apertures, crevices, gaps or the like, with the gas spaces of these apertures, crevices, gaps or the like being connected to the gas space of the flue gas channel extending beneath. The invention furthermore relates to a floor segment which is at least formed of these two layers, and to a method in which one or several of the afore-mentioned coke ovens are used.

Heating of heat-recovery coke ovens is usually performed by combustion of gas evolving in the course of coal carbonisation. The combustion is so controlled that part of the gas burns off above the coal charge with primary air in the oven chamber. This partly burnt gas is supplied through channels, which are also designated as "downcomers", to the heating flues of the oven chamber sole and burnt here completely by addition of further combustion air designated as secondary air. In this way, heat is supplied to the coal charge directly from the top and indirectly from the bottom, thus taking a favourable effect on the coking rate and, thereby, on the oven performance rate.

In principle, the prior art coke ovens work reliably, but are afflicted with a disadvantage in that it takes long coking times of up to 60 hours to well carbonise the coke cake. Now, therefore, it is the objective of the present invention to disclose a coke oven and a method by means of which shorter coking times are achieved.

BRIEF SUMMARY OF THE INVENTION

It was found that one cause for the coking time is the massive oven floor which must bear the coal charge. This oven floor is marked by a substantial resistance to thermal conductivity so that the bottom side of a coal charge is carbonised substantially slower than the top side. Therefore, the present invention solves this task by providing a horizontal chamber coke oven which consists of a coke oven chamber, a coke oven floor, and several horizontally extending flue gas channels arranged beneath the coke oven floor in the area of the oven sole. In vertical direction, the coke oven floor situated between the coke oven chamber and flue gas channel is built up of at least two layers and supported on the walls of the flue gas channels. Each of these layers is formed of the same or different refractory materials, for example, silica material, fireclay, etc. A distinctive feature of the inventive coke oven lies in that the first layer, viewed from the oven space, is formed of a solid material, and that the second layer comprises a plurality of apertures, crevices, gaps, small channels or the like, with the gas spaces of these apertures, crevices, gaps, channels or the like being connected to the gas space of the flue gas channel extending beneath.

The second layer ideally has an arch-like swung shape, and the first layer has at least one plane top side on which the coke cake and/or coal or coke charge rests during the coking time in the intended operation. The coke oven can be further improved by arranging at least another layer or transitional elements between the first and second layer.

With existing temperatures of around 800° C., the convective portions of heat transport are of secondary importance versus the heat transport portion conditioned by radiation, so that no gas must stream in the apertures, channels, etc. By implementing the second layer in form of such a checker work, the static system of the coke oven is therefore influenced just slightly, but the thickness of the load-bearing coke oven floor can be reduced by up to 40%. This leads to a substantial reduction of the mean resistance to thermal conductivity of the coke oven floor and consequently to a substantial shortening of coking time and increase in oven performance rate, respectively. A positive by-effect is caused as the increased surface roughness of the flue gas channel top leads to a local reduction of the flow velocity, thereby achieving an increase in transferable heat volume per time unit, too.

Another optimisation lies in that the second layer is formed of shaped bricks which are made of solid material and which are so arranged that apertures, crevices, gaps or the like are formed between adjacent shaped bricks or the wall. The advantage of this structural design is its simple implementation because the identical wedge-shaped decking bricks can be utilised that are already utilised for the full-surface channel top which is already known from prior art in technology.

An optimisation of the coke oven lies in that the second layer is formed of shaped bricks, with each individual shaped brick having at least one aperture, crevice, gap, channel or the like and with each individual shaped brick ideally having several apertures, crevices, gaps, channels or the like. Depending on structural design requirements, the two possibilities mentioned above can also be combined to generate gaps or shaped bricks with channels with solid-material shaped bricks.

To meet certain requirements, the open cross-section of the apertures, crevices, gaps or channels in the sub-layer may differ. Different cross-sections of the apertures allow for optimising the gas routing and heat flow. For example, it may particularly happen that the open cross-section of the facilities in the area of doors and oven walls is increased in order to enable an even distribution of the heat flow in the entire range of the gas discharge channel. To ensure precise dimensioning of the apertures, their cross-sections can be calibrated. Thereby it is possible, depending on the type of embodiment of the present invention, to harmonise the carbonisation process over the entire length of the coke oven. Furthermore, heating deficiencies can also be compensated for by this kind of aperture configuration. Another improvement in heat transfer can be achieved, if at least one additional layer is arranged between the first and second layer, wherein the shaped brick forming the first layer is formed of a covering layer and a sub-layer, with the covering layer being formed of solid material and the sub-layer being formed of a plurality of apertures, crevices, gaps, channels or the like and forming this additional intermediate layer.

If the first layer consists of two plane-parallel sides, and if the second layer has been designed and constructed like a vault similar to an arch, it is basically required to provide a compensating intermediate layer or transitional elements so as to enable the first layer to ideally rest on the second layer. In this case, an improved embodiment of the present invention lies in that the intermediate layer or transitional bricks intended to compensate for different contours of the layers are formed of shaped bricks which have at least one aperture, crevice, gap, channel or the like.

The coke oven floor which is formed of a great deal of individual bricks must be bricked-up with substantial expenditure on time. This expenditure on time can be substantially diminished by means of a further embodiment of the inventive coke oven if the coke oven floor in vertical direction is formed of one solid-piece floor segment only which has a covering layer and a sub-layer, with said covering layer being formed of solid material and said sub-layer being formed of a plurality of apertures, crevices, gaps, channels or the like.

These floor segments ideally are so shaped that they have a concave arch on their bottom side. In the embodiment of the inventive method, the sub-layer of these floor segments may also form the top ceiling of the flue gas channel. In the intended operation of the device, the coke cake or coke charge are situated on the covering layer of the coke oven floor. Therefore, the covering layer usually is not shaped like an arch, but it is built in a plane-horizontal type of construction.

To facilitate the structural construction of the coke oven, the floor shaped bricks advantageously already have the contour of the finished floor in their outer shape. In this way, the floor shaped bricks intended for the second layer may already have an arch-like swung shape as single components. Conversely, the floor shaped bricks intended for the first layer as single components advantageously have a plane configuration on their upper side.

To facilitate the structural construction even more particularly, the floor shaped bricks may also be so shaped and dimensioned in their size that they are adapted to the width of the relevant flue gas channel and to the thickness of the flue gas channel walls in their entire extension. Each floor shaped brick then spans over the flue gas channel in its entire width and rests on the flue gas channel walls with its ends. A plurality of floor shaped bricks lying in parallel on the flue gas channel then spans over the flue gas channel.

Furthermore, the present invention covers a method for the production of coke in which a coke oven in one of the aforementioned embodiments is used.

DETAILED DESCRIPTION OF THE INVENTION

Figure 1:
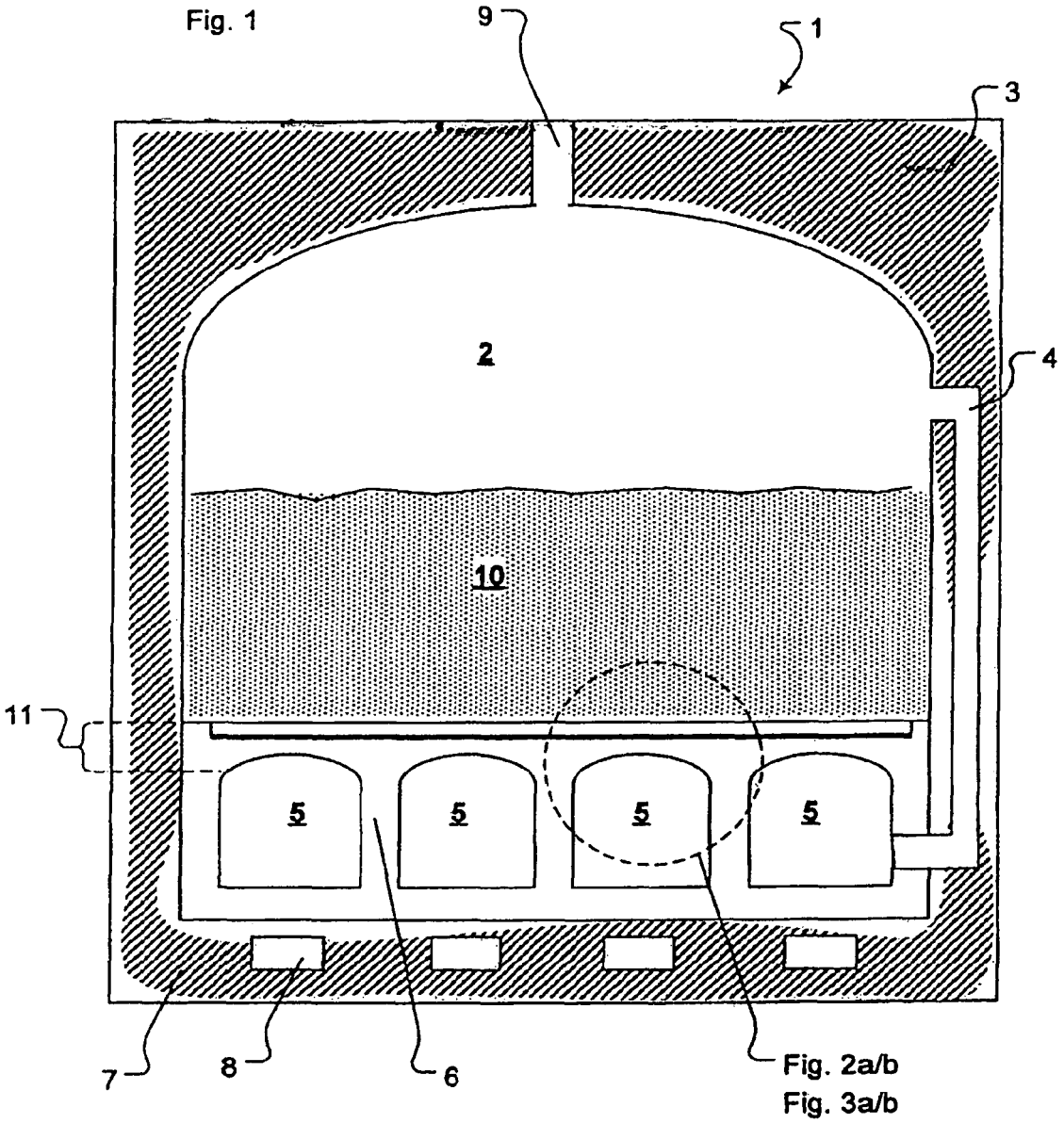
FIG. 1 shows a coke oven of horizontal construction.

Some variants of the embodiments of the present invention are described more closely in the following to serve as examples based on FIGS. 1 to 3*b*. In a sectional view, FIG. 1 shows a prior-art coke oven 1 of horizontal construction. The actual coke oven chamber 2 is enclosed by the exterior walls 3 and supplied with combustion air through the primary air duct 9. The combustion gases are passed from the coke oven chamber 2 through a wall channel, i.e. the so-called downcomer 4, into the flue gas channels 5 which extend beneath the coke oven floor 11. The flue gas channels 5 are separated through partition walls 6, but are linked to each other in a way not shown here. Secondary air ducts 8 extending under the flue gas channels 5 make it possible to control the combustion in the flue gas channels 5. The coal charge and, respectively, the coke cake 10 in the intended operation lies as a bulk charge or compacted cake on the coke oven floor 11.

Figure 2A:
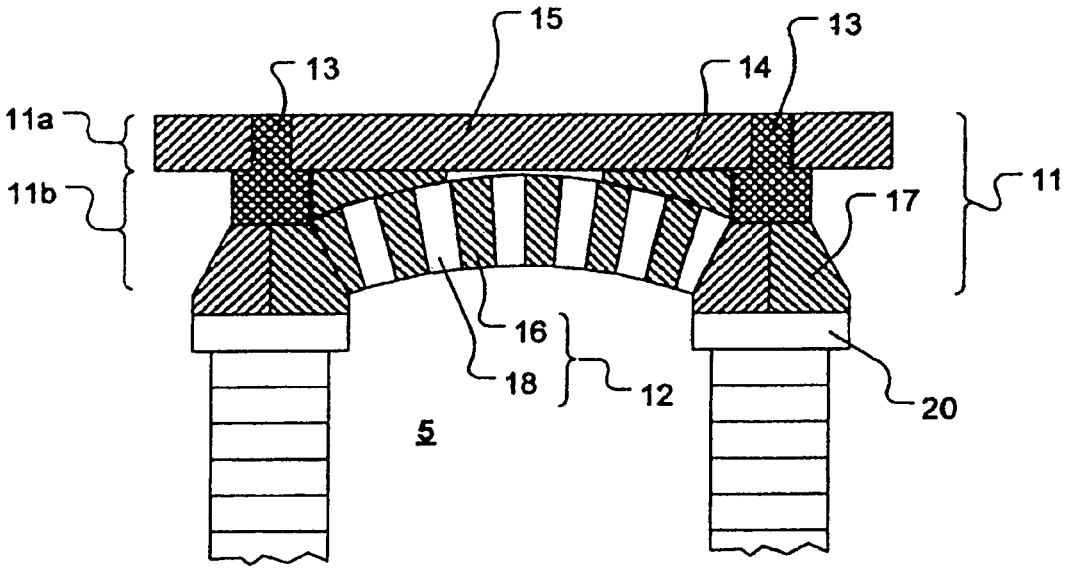
FIG. 2*a* shows a detail view of a coke oven floor.
Figure 2B:
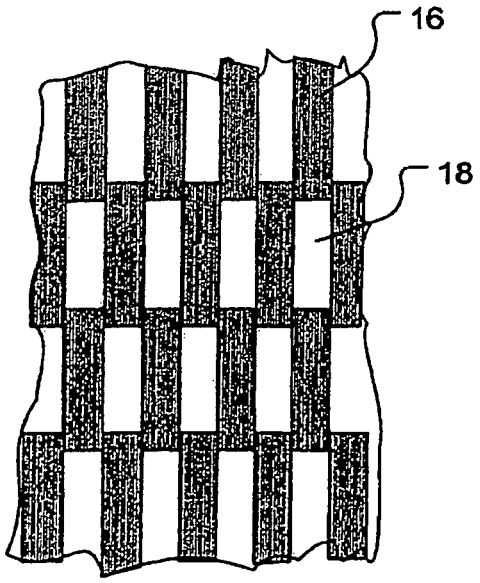
FIG. 2*b* shows a cross-sectional view across element 16 and 18.

In a sectional view, FIG. 2*a* shows the coke oven floor 11 in detail. The coke oven floor 11 which is formed of the two layers 11*a* and 11*b* rests on the partition walls which are formed of partition wall bricks 20. The actual surface of the coke oven floor 11 is formed of flat floor plates 15 which rest on the horizontal transitional bricks 13. These horizontal transitional bricks 13 form the vertical closure of the partition walls 6. Arranged beneath the transitional brick 13 are two supporting bricks 17 which in turn rest on the bricked crowns of the relevant partition wall 6. The partition wall 6 is formed of quad-like shaped bricks 20. Supported at the flanks of the supporting bricks 17 is the top ceiling 12 of the flue gas channel 5 which is shaped like an arch and which is formed of a plurality of wedge-shaped decking bricks 16. The decking bricks 16 are so arranged that a gap 18 or a channel is always created between the decking bricks 16 as shown in the bottom view of top ceiling 12 in FIG. 2*a*. Another advantage of the present invention lies in that less construction material is needed for the checker work in the sub-layer 11*b*, which is an economic benefit.

Figure 3A:
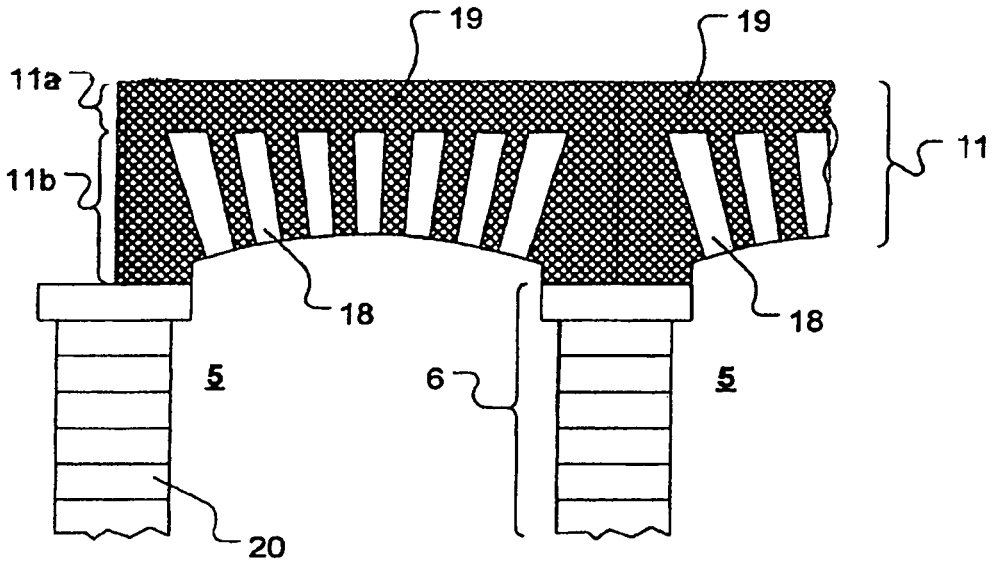
FIG. 3*a* shows a view of a coke oven floor according to the present invention.
Figure 3B:
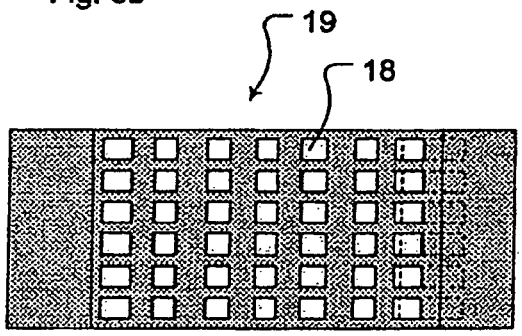
FIG. 3*b* shows a bottom view of floor segment 19.

In a sectional view, FIG. 3*a* shows the setup of the coke oven floor, if the inventive floor segments 19 are implemented. In vertical direction, the floor segment 19 is configured as a continuous shaped brick, which when built-in rests on two partition walls 6 each. On construction, apertures, channels 18 or the like have been provided for in the floor segment 19. The unilaterally open channels 18 are connected to the gas space of the flue gas channel 5. In the example shown here, the channels 18 do not run perpendicular to the first layer 11*a*, but they are arranged like a fan so that only the smallest possible areas of the first layer 11*a* remain non-connected to the ends of channels 18. FIG. 3*b* shows the bottom view of the floor segment 19. For the sake of clarity, the shadow edges of the top channels 18 are shown in dashed lines only for one row of the top channels 18.

LIST OF REFERENCE SYMBOLS

1 Coke oven
2 Coke oven chamber
3 Exterior wall
4 Downcomer
5 Flue gas channel
6 Lateral partition wall of flue gas channel
7 Coke oven foundation
8 Secondary air duct
9 Primary air duct
10 Coke cake, coke charge
11 Coke oven floor
11*a* first layer, covering layer
11*b* second layer, sub-layer
12 Top ceiling of flue gas channel
13 Horizontal transitional brick
14 Vertical transitional brick
15 Floor plate
16 Decking brick of flue gas channel
17 Supporting brick
18 Top channel, gap, aperture
19 Shaped brick, floor segment
20 Shaped brick of partition wall

The invention claimed is:

1. A horizontal coke oven comprising a coke oven chamber, a coke oven floor, and several horizontally extending flue gas channels arranged beneath the coke oven floor, the flue gas channels being limited by walls, with the coke oven floor situated between the coke oven chamber and flue gas channel, the coke oven floor being built up of at least two layers in vertical direction and supported on the walls of the flue gas channels, and wherein each layer is formed of the same or different refractory materials, wherein, viewed from the coke oven chamber, the first layer comprises a covering layer formed of solid material, and the second layer represents a sub-layer beneath the first layer comprising a plurality of apertures, crevices or gaps, the plurality of apertures, crevices or gaps forming gas spaces in them, with the gas spaces in these apertures, crevices or gaps being connected with the gas space of the flue gas channel extending beneath.

2. The horizontal coke oven according to claim 1, wherein the second layer has an arch-like swung shape and that the first layer has a flat top side.

3. The horizontal coke oven according to claim 1, comprising at least one other layer of transitional elements is arranged between the first and second layer.

4. The horizontal coke oven according to claim 3, wherein the one other layer is made of transitional bricks and compensates for different contours of the layers, the different contours formed by the first layer that has a flat top side and the second layer that has an arch-like swung shape.

5. The horizontal coke oven according to claim 1, wherein the second layer is formed of shaped bricks made of solid material which are so arranged that a plurality of apertures, crevices or gaps is formed between adjacent shaped bricks.

6. The horizontal coke oven according to claim 1, wherein the second layer is formed of a plurality of shaped bricks, with each individual shaped brick having at least one of the plurality of apertures, crevices or gaps aperture, crevice or gap so that the plurality of shaped bricks forms the plurality of apertures, crevices or gaps in the second layer being connected with the gas space of the flue gas channel extending beneath.

7. The horizontal coke oven according to claim 6, wherein the second layer is formed of a plurality of shaped bricks, with each individual shaped brick having several of the plurality of apertures, crevices or gaps so that the plurality of shaped bricks forms the plurality of apertures, crevices or gaps in the second layer being connected with the gas space of the flue gas channel extending therebeneath.

8. The horizontal coke oven according to claim 6, wherein the second layer is formed both of a plurality of shaped bricks made of a solid refractory material without apertures, crevices or gaps and additionally of a plurality of shaped bricks made of a solid refractory material each comprising at least one of the plurality of apertures, crevices and gaps aperture, crevice or gap.

9. The horizontal coke oven according to claim 1, wherein one other layer is arranged between the first and second layer, with the shaped bricks forming the first layer and the one other layer, the shaped bricks being themselves comprised of a brick covering layer and a brick sub-layer, wherein the brick covering layer represents the first layer and is formed of a solid refractory material and wherein the brick sub-layer represents the one other layer and is comprised of shaped bricks with each individual shaped brick having at least one of the plurality of apertures, crevices or gaps.

10. The horizontal coke oven according to claim 1, wherein the coke oven floor is in vertical direction formed of one solid-piece segment only, wherein the solid piece segment is made of a solid refractory material having in the solid refractory material the plurality of apertures, crevices or gaps being connected with the gas space of the flue gas channel extending beneath.

11. The horizontal coke oven according to claim 10, wherein the solid piece segment which forms the coke oven floor is concavely arched on its bottom side.

12. The horizontal coke oven according to claim 1, wherein the area of the cross-sections of the openings of the apertures, crevices or gaps in the second layer are different.

13. The horizontal coke oven according to claim 1, wherein the areas of the cross-sections of the openings of the apertures, crevices or gaps in the second layer increases in the area of doors and/or oven walls without an adjacent oven.

14. Use of a coke oven of horizontal construction as defined in claim 1 for the production of coke, wherein:

a coke oven according to claim 1 is put up; and the coal charge, and, respectively the coke cake in the intended operation is positioned as a bulk charge or compacted cake on the coke over floor; and heating is carried out by combustion of gas evolving in the course of carbonization so that pert of the gas burns off above the coal charge with primary air in the oven chamber, and the partly burnt gas is supplied through channels, which are also designated as "downcomers", to the heating flues of the oven chamber sole and burnt here completely by addition of further combustion air designated as secondary air; and a coke oven according to claim 1 with apertures, crevices or gaps forming gas spaces in the second layer is used so that the thickness of the load-bearing coke oven floor can be reduced by up to 40% and a reduction of the mean resistance of thermal conductivity of the coke oven floor is achieved.

15. A horizontal coke oven comprising a coke oven chamber, a coke oven floor, and several horizontally extending flue gas channels arranged beneath the coke oven floor, the flue gas channels being limited by walls, with the coke oven floor situated between the coke oven chamber and flue gas channel, the coke oven floor being built up of at least two layers in vertical direction and supported on the walls of the flue gas channels, and wherein each layer is formed of the same or different refractory materials, wherein, viewed from the coke oven chamber;

the first layer represents a covering layer formed of solid material; and the second layer represents a sub-layer beneath the first layer comprising a plurality of apertures, crevices or gaps, the plurality of apertures, crevices or gaps forming gas spaces in them, with the gas spaces in these apertures, crevices or gaps being connected with the gas space of the flue gas channel extending beneath; and the area of the cross-sections of the openings of the apertures, crevices or gaps in the second layer are different.

* * * * *

UNITED STATES PATENT AND TRADEMARK OFFICE

CERTIFICATE OF CORRECTION

PATENT NO. : 9,115,313 B2
APPLICATION NO. : 12/227999
DATED : August 25, 2015
INVENTOR(S) : Werner Hippe It is certified that error appears in the above-identified patent and that said Letters Patent is hereby corrected as shown below:

In the Claims:

In Claim 14, line 21, Column 6, wherein the word "over" should be --oven--.
In Claim 14, line 23, Column 6, wherein the word "pert" should be --part--.

Signed and Sealed this
Thirty-first Day of May, 2016

Michelle K. Lee

Michelle K. Lee
*Director of the United States Patent and Trademark Office*